US012607354B2

(12) United States Patent
Arias et al.

(10) Patent No.: US 12,607,354 B2
(45) Date of Patent: Apr. 21, 2026

(54) FIRE STARTER

(71) Applicant: Better Horse, Inc., Virginia Beach, VA (US)

(72) Inventors: David A. Arias, Virginia Beach, VA (US); Michael D. Beyrodt, Norfolk, VA (US)

(73) Assignee: Better Horse, Inc., Virginia Beach, VA (US)

( * ) Notice: Subject to any disclaimer, the term of this patent is extended or adjusted under 35 U.S.C. 154(b) by 289 days.

(21) Appl. No.: 18/106,400

(22) Filed: Feb. 6, 2023

(65) Prior Publication Data

US 2024/0263781 A1 Aug. 8, 2024

(51) Int. Cl.
*F23Q 2/36* (2006.01)
*F23Q 2/18* (2006.01)

(52) U.S. Cl.
CPC . *F23Q 2/36* (2013.01); *F23Q 2/18* (2013.01)

(58) Field of Classification Search
CPC ..... F23Q 2/36; F23Q 2/18; F23Q 1/06; F23Q 1/04; C10L 11/08; C10L 11/04; C10L 11/02; C10L 11/06; C10L 11/00
USPC ..... 431/356; 44/533, 534, 532
See application file for complete search history.

(56) References Cited

U.S. PATENT DOCUMENTS 1,401,803 A 12/1921 Lynes
3,515,525 A 6/1970 Fearon
3,566,857 A 3/1971 Price
3,994,666 A 11/1976 Spinosa et al.
4,460,377 A 7/1984 Kalil
4,583,940 A 4/1986 Zellweger et al.
4,762,525 A 8/1988 Wood
4,832,703 A 5/1989 Campana et al.
4,964,469 A * 10/1990 Smith ..... A62C 19/00 169/53
5,186,721 A 2/1993 Campana
5,552,001 A 9/1996 Fearon
5,743,248 A 4/1998 Jansen, Jr.
(Continued)

FOREIGN PATENT DOCUMENTS

FR 2 698 100 A1 5/1994
GB 2 235 209 A 2/1991

OTHER PUBLICATIONS

International Search Report and Written Opinion for PCT Application No. PCT/US2024/014275 dated May 15, 2024, 11 pages.

*Primary Examiner* — Vivek K Shirsat
(74) *Attorney, Agent, or Firm* — COOLEY LLP

(57) ABSTRACT

An apparatus according to an embodiment includes a casing that has a first side portion, a second side portion opposite the first side portion, and an interior chamber therebetween. The casing is made from a first burnable material. A second burnable material is disposed in the interior chamber. An igniter is disposed in the interior chamber and is configured to generate a first thermal event to ignite the second burnable material that, during combustion, causes a second thermal event that ignites the first burnable material. A safety tab is removably coupled to the igniter. The safety tab is configured to prevent generation of the first thermal event when the safety tab is coupled to the igniter, and to allow generation of the first thermal event when the safety tab is removed from the igniter. An actuator coupled to the igniter is configured to activate the igniter to generate the first thermal event.

18 Claims, 7 Drawing Sheets

(56) References Cited

U.S. PATENT DOCUMENTS

| | | | | |
|---|---|---|---|---|
| 6,558,440 | B1 | 5/2003 | Price, Jr. | |
| 7,670,392 | B2 | 3/2010 | Correa et al. | |
| 7,789,919 | B2 | 9/2010 | Helms, Jr. et al. | |
| 7,823,576 | B2 | 11/2010 | Timmons et al. | |
| 8,597,381 | B2 | 12/2013 | Paapsi | |
| 9,933,160 | B2 * | 4/2018 | Beyrodt | C10L 11/06 |
| 9,945,559 | B2 | 4/2018 | Beyrodt | |
| 10,641,485 | B2 | 5/2020 | Beyrodt | |
| 11,415,318 | B2 | 8/2022 | Beyrodt | |
| 2009/0159073 | A1 | 6/2009 | Giordano | |
| 2011/0262874 | A1 | 10/2011 | Kraminer | |
| 2014/0087315 | A1 | 3/2014 | Doyle et al. | |
| 2018/0148659 | A1 | 5/2018 | Mathews | |
| 2021/0003372 | A1 | 1/2021 | Monetti et al. | |
| 2023/0117914 | A1 | 4/2023 | Beyrodt | |

* cited by examiner

FIRE STARTER

FIELD

One or more embodiments relate generally to fire starting apparatus, and more particularly to a self-contained fire starter with an improved safety feature to prevent inadvertent combustion of the fire starter.

BACKGROUND

Known methods of starting a fire in an outdoor environment can be time-consuming and unreliable. Typically, one starts a fire by placing dry kindling wood and paper below a stack of logs or charcoal. The paper is ignited and, if all goes well, the stack of logs eventually ignites. The success of known methods, however, depends on a number of factors, including weather conditions, the amount and condition of combustible materials used, and the experience of the user. Consequently, alternative methods of starting fires have been proposed that are relatively unaffected by weather conditions, do not require the use of paper or kindling wood, and require little or no skill to use.

Alternative fire starting methods generally involve the use of either liquid-fuel or solid-fuel fire starters. Liquid-fuel fire starters have the disadvantage of being highly flammable and are subject to flashbacks, making them more dangerous to store and use than solid fuels. Solid-fuel fire starters are commonly blocks of paraffin wax mixed with a cellulose material such as sawdust or woodchips. The blocks are placed on a support located below a stack of wood, charcoal, etc., and are ignited using a manually-held flame source such as a match or lighter thereby requiring the user to have at least his hand in proximity to the fire area. Solid-fuel fire starters can also be wrapped in a flammable bag that the user lights to, in turn, light the solid fuel. Solid-fuel fire starters, however, are typically subject to a user's ability to hold a match or lighter up to the fire starter long enough to allow the flammable bag and/or the solid fuel to combust. This requirement can present significant challenges when in a windy outdoor environment.

An object of the present invention is to improve upon such known fire starters to improve the safety thereof, such as by incorporating a safety tab that interrupts the chain of thermal events so that the fire starter does not combust when the safety tab is in place.

SUMMARY

An apparatus according to an embodiment includes a casing that has a first side portion and a second side portion opposite the first side portion and that defines an interior chamber between the first side portion and the second side portion. The casing is made from a first burnable material. The apparatus also includes a second burnable material disposed in the interior chamber of the casing, an igniter, a safety tab and an actuator. The igniter is disposed in the interior chamber of the casing and is configured to generate a first thermal event to ignite the second burnable material that, during combustion, causes a second thermal event that ignites the first burnable material. The safety tab is removably coupled to the igniter and is configured to prevent generation of the first thermal event when the safety tab is coupled to the igniter. The safety tab is configured to allow generation of the first thermal event when the safety tab is removed from the igniter. The actuator is coupled to the igniter and is configured to activate the igniter to generate the first thermal event.

BRIEF DESCRIPTION OF THE DRAWINGS

Corresponding reference characters indicate corresponding parts throughout the several views of the drawings.

DETAILED DESCRIPTION

Figure 1:
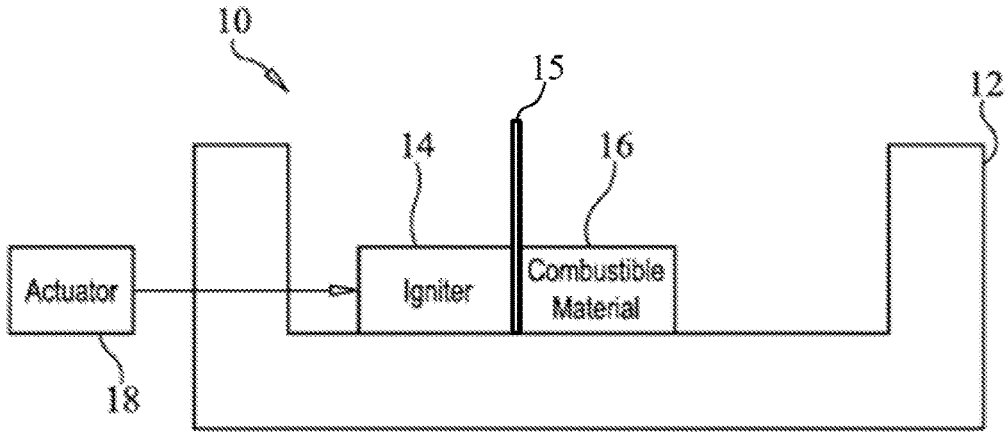
FIG. 1 is a schematic view of a fire starter in accordance with an embodiment.

Referring now to the drawings and more particularly to FIG. 1, a fully self-contained fire starter in accordance with an embodiment is shown and is referenced generally by numeral 10. Fire starter 10, as well as all other embodiments described and/or illustrated herein, is self-contained in that no external source of thermal energy is required to initiate combustion. Rather, the fire starter need only be placed in a fire-starting location and activated by a simple and non-thermal manual activity to initiate combustion. While the fire starter can be used in indoor and outdoor environments, a great advantage of one or more embodiments described herein is that the fire starter will work even in very windy, outdoor environments.

The fire starter 10 is a novel arrangement of elements that, when activated, produce a plurality of thermal events with the last thermal event being an enduring flame suitable for starting a fire in a stack of wood, charcoal, etc. Fire starter 10 includes an outer casing 12, an igniter 14 disposed in casing 12, a safety tab 15 coupled to the igniter 14, a combustible material 16 disposed in casing 12 adjacent to the safety tab 15, and an actuator 18 coupled to igniter 14 and positioned outside of casing 12. While the overall size of fire starter 10 is not a limitation of the embodiment, the entirety of fire starter 10 can generally be a hand-held structure.

Casing 12 is made from a combustible material that provides the fuel for the final thermal event (i.e., a fire-starting enduring flame) for an activated fire starter 10. In general, the casing 12 is made from a solid material that, once ignited, will burn for a sufficient period of time to ignite surrounding wood, charcoal, etc. that is adjacent to a burning casing 12. A suitable material choice for casing 12 is a mixture of paraffin wax and a cellulose material such as sawdust, woodchips, etc. The ratio of paraffin wax to cellulose material can be "one-to-one" or "greater-than-one to one" without departing from the scope of the embodiment. In general, flame height will increase but the flame's life span will decrease with increasing amounts of paraffin wax. Accordingly, the ratio of paraffin wax to cellulose material can be tailored to suit a product's application. By way of example, a ratio of paraffin wax to cellulose material of approximately 1.5 to 1 provides a good balance between flame height and life span for most indoor and outdoor applications. For example, when casing 12 is constructed with this ratio and such that it can be hand-held, the burning life span of casing 12 can easily be in the range of approximately 20 minutes to approximately 60 minutes.

Casing 12 can be formed or constructed to define a well or an internal chamber in which igniter 14 and combustible material 16 are disposed. As will be explained further below, if casing 12 forms part of, or all of, a chamber that houses igniter 14 and combustible material 16, vent holes (not shown) can be provided to admit outside air to flow into the chamber. Casing 12 can be a unitary body or could be assembled arrangement of casing portions without departing from the scope of the embodiment.

Combustible material 16 is the fuel for a thermal event that will trigger the combustion of casing 12. In general, the thermal event created when combustible material 16 combusts should last long enough to ignite casing 12 to combustion. To assure efficient combustion of combustible material 16 even in a low-level oxygen environment, an oxidizer can be included in combustible material 16. When casing 12 forms part of, or all of, an internal chamber housing combustible material 16, the inclusion of an oxidizer in combustible material 16 is particularly beneficial. The length of time that combustible material 16 should burn will generally be less than the burn time associated with casing 12. By way of example, when casing 12 is made from the above-described mixture of paraffin wax and cellulose material, combustible material 16 can be a mixture of materials capable of burning for a time in the range of approximately 20 seconds to approximately 95 seconds. Such mixtures can be readily found in road flare technologies where such mixtures generally include the following materials noted with a range of weight percent:

| Material | Weight Percent |
|---|---|
| Strontium nitrate | 67-78% |
| Potassium nitrate | 2-11% |
| Sulfur | 6-15% |
| Polyvinyl chloride | 1-10% |
| Paraffin oil | 1-4% |
| Sawdust | 0-2% |

Note that potassium nitrate defines the oxidizer in these types of mixtures.

The safety tab 15 is removably coupled to the igniter 14. The safety tab 15 can, in some embodiments, be removably disposed between the igniter 14, or a portion of the igniter, and the combustible material 16, and optionally a second portion of the igniter. For example, the portion of the igniter 14 that generates the thermal event can be spaced apart from the combustible material, and the second portion of the igniter 14 can be positioned adjacent to or within the combustible material 16. An air gap (not shown) can be present between the igniter (or portion thereof) and the combustible material 16, however, any such air gap is of limited size to permit the thermal event from the igniter 14 to reach and combust the combustible material 16 when the safety tab 15 is removed.

In general, igniter 14 is capable of generating a thermal event that triggers the combustion of combustible material 16 after the safety tab 15 has been removed. That is, the thermal event produced by igniter 14 should last long enough to ignite combustible material 16. Depending on the material used for combustible material 16, the thermal event provided by igniter 14 (when activated) could be a spark, a small burn event (e.g., a burning fuse), a chemical reaction, or the like, or a combination of the foregoing. By way of example, when using the above-noted mixtures for combustible material 16, igniter 14 can provide a small burn event having a burn time in the range of approximately 2 seconds to approximately 5 seconds.

The safety tab 15 is removably coupled to the igniter 14. The safety tab, when coupled to the igniter 14, prevents generation of the thermal event produced by the igniter 14. For example, at least a portion of the safety tab 15 can be positioned within the casing 12 between the igniter 14, or a portion thereof, and the combustible material 16. In other embodiments, the safety tab 15 can be at least partially disposed in or through the igniter 14 (not shown in FIG. 1), when the safety tab 15 is coupled thereto. Although not shown in FIG. 1, in some embodiments, the safety tab 15 can include an end portion removably coupled to the igniter 14 and an opposing end portion disposed external to the casing 12. In this manner, shortly prior to use of the fire starter 10, a user can pull on the end portion of the safety tab 15 external to the casing 12 to remove the safety tab 15 from the igniter 14. The safety tab 15, when removed from the igniter 14, allows (or otherwise discontinues preventing) generation of the thermal event. Although the safety tab 15 is described as being pulled to be removed from the igniter 14, in some implementations, the safety tab 15 can be pushed or pressed to be uncoupled from the igniter 14 such that the igniter 14 can produce the thermal event.

Actuator 18 is coupled to igniter 14 but is positioned outside of casing 12. In general, actuator 18 is a manually-operated element that activates igniter 14 such that igniter 14 produces the igniter's above-described thermal event. As mentioned above, the manual operation applied to actuator 18 does not include or require the application of any external source of thermal energy. Actuator 18 can be realized by a structure that is manually pulled or manually pushed where such action activates igniter 14. In some implementations, the actuator 18 is configured to be actuated in a first direction, and the safety tab 15 is configured to be moved in a second direction different from the first direction to uncouple the safety tab 15 from the igniter 14.

Figure 2:
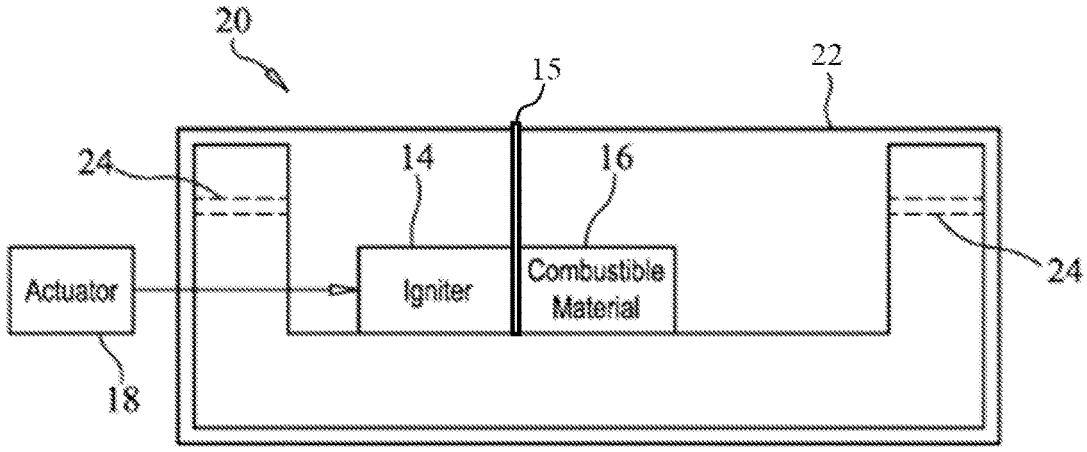
FIG. 2 is a schematic view of a fire starter with a paper overwrap in accordance with another embodiment.

Another embodiment of a fire starter 20 is illustrated in FIG. 2. Fire starter 20 includes the components of fire starter 10, and further includes an overwrapping of paper 22 that can improve the fire starter's performance in a windy environment, provide a base for the printing of use instructions, protect casing 12, etc. When paper overwrap 22 is used, it can be beneficial to provide vent holes 24 in casing 12 where each vent hole 24 provides a fluid (air) communication path between the air surrounding combustible material 16 and the air outside of casing 12. Paper overwrap 22 is selected such that, when combustible material 16 burns, paper overwrap 22 readily ignites thereby making air available at the external surfaces of casing 12 for passage through vent holes 24. For example, paper overwrap 22 can be made using standard twenty-pound paper. The air available via vent holes 24 improves the combustion efficiency of combustible material 16. The safety tab 15 can be extended through an opening (not shown) in the paper overwrap 22, such that a portion of the safety tab 15 is accessible to the user external to the paper 22 and casing 12.

Figure 3:
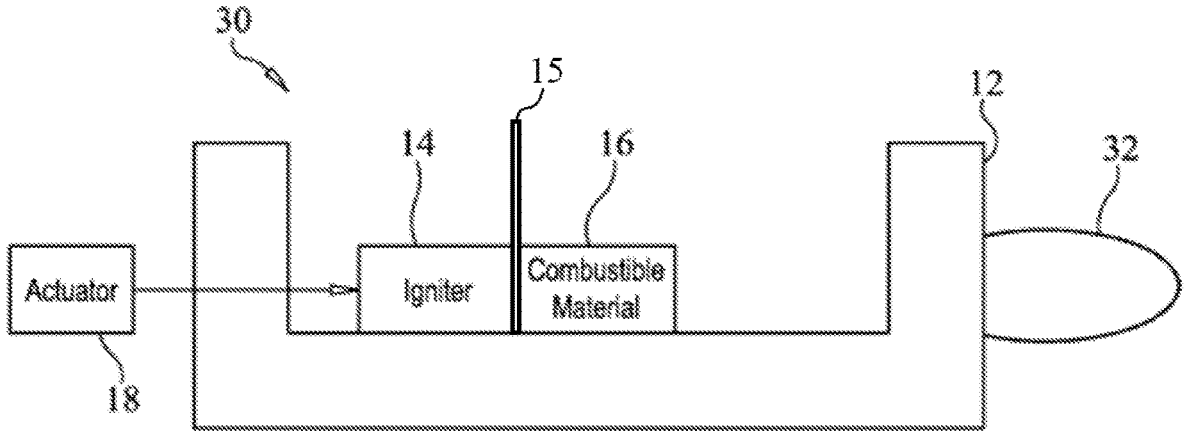
FIG. 3 is a schematic view of a fire starter with an anchoring loop in accordance with another embodiment.

FIG. 3 shows fire starter 30 according to another embodiment. Fire starter 30 includes the components of fire starter 10 (and can include one or more of the additional features of fire starter 20), and further includes an anchoring line 32 extending from casing 12. Anchoring line 32 can define a loop as shown that facilitates attachment of fire starter 30 to a piece of wood, log, etc., in a material stack (not shown) that is to be ignited by fire starter 30. Although fire starter 30 shows the anchoring line 32 extended from the casing 12 in a direction different from the safety tab 15, in some implementations, the safety tab 15 is extended from the casing in the same direction as the anchoring line 32. For example, the safety tab 15 can define a bend between a first end portion and a second end portion thereof such that the first end portion coupled to the igniter 14 has a first elongate axis and the second end portion extended in the direction of the anchoring line 32 has a second elongate axis that is transverse or substantially perpendicular to the first elongate axis of the first end portion.

Figure 4:
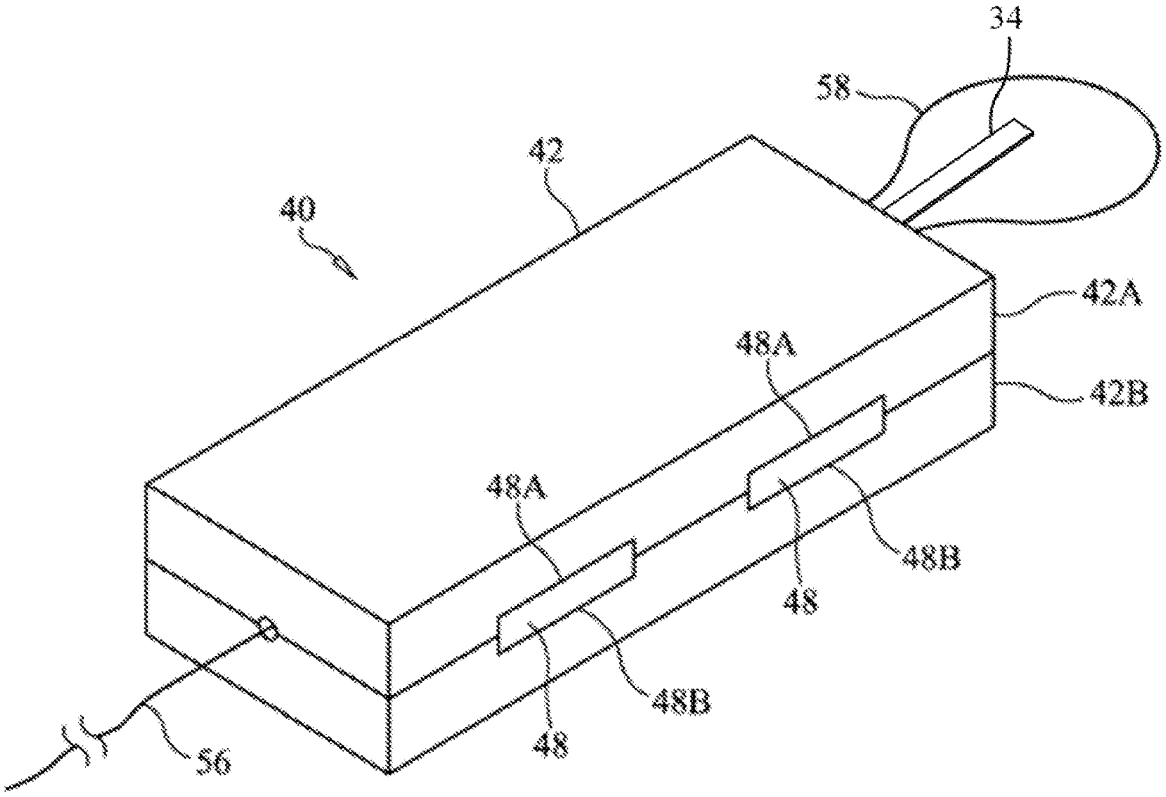
FIG. 4 is a perspective view of a fire starter having a pull string activator and anchoring loop in accordance with an embodiment.
Figure 5:
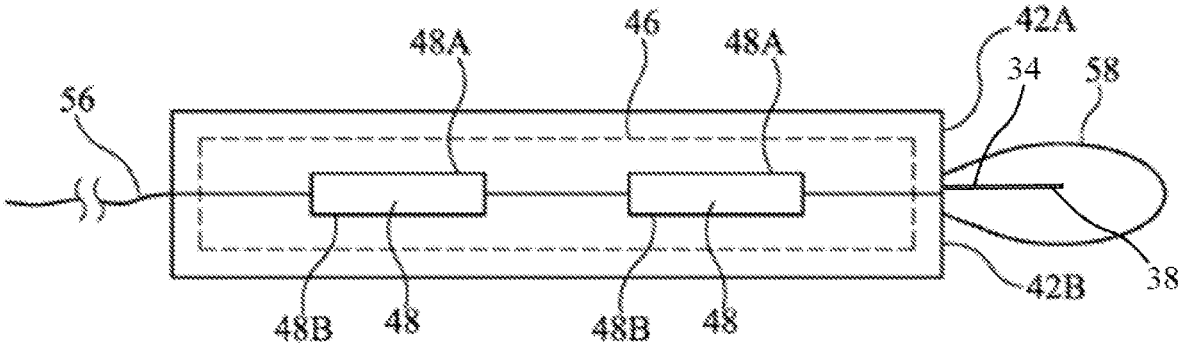
FIG. 5 is a side view of the fire starter depicted in FIG. 4.
Figure 6:
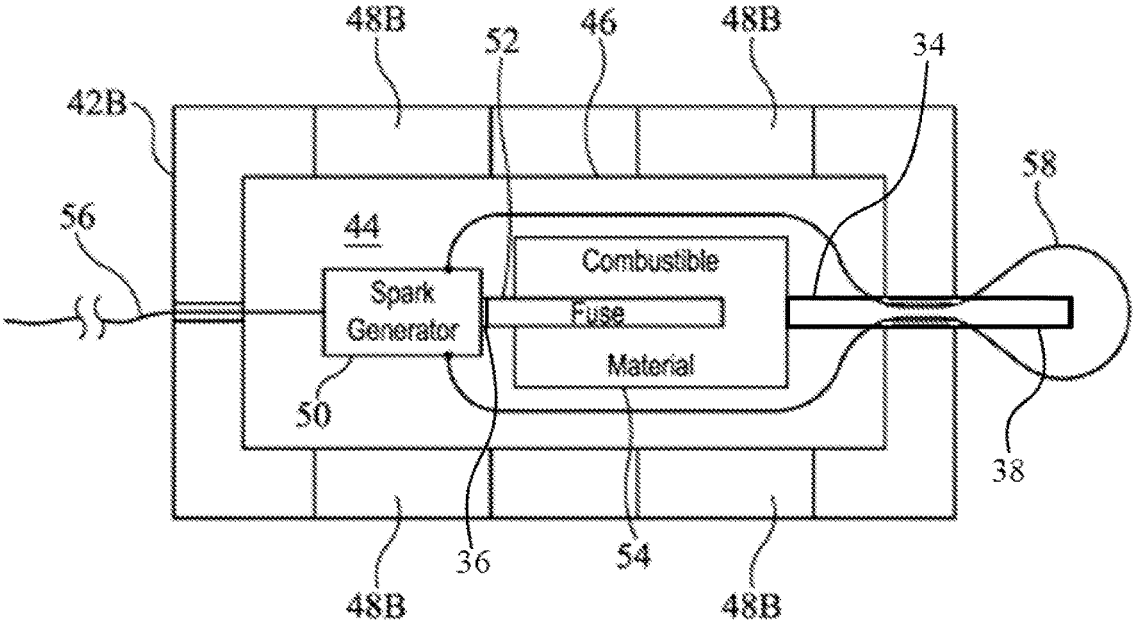
FIG. 6 is a plan view of the lower half of the FIG. 4 fire starter's casing illustrating the components disposed therein in accordance with an embodiment.

Another embodiment will be described with simultaneous reference to FIGS. 4-6 where the fire starter is referenced generally by numeral 40. Fire starter 40 includes a casing 42 made from identical top and bottom clam shell portions 42A and 42B, respectively. Casing 42 has the same or similar material and combustion attributes as casing 12. Each clamshell-shaped casing portion 42A and 42B includes a well region 44 (visible for portion 42B in FIG. 6) such that, when casing portions 42A and 42B are positioned against one another in a mirror-image fashion, the two well regions join to define a chamber 46 (represented by broken lines in FIG. 5) in casing 42. Channels 48A/48B are defined in casing portions 42A/42B such that a corresponding plurality of vent holes 48 are defined in casing 42 when casing portions 42A and 42B are positioned against one another. Each vent hole 48 defines a fluid communication path between the outside of casing 42 and chamber 46.

Disposed in well region 44 (FIG. 6), that will become part of chamber 46 when casing portions 42A and 42B are positioned against one another, are a spark generator 50, a fuse 52 coupled to spark generator 50 and extending therefrom, and a combustible material 54 in contact with fuse 52. A safety tab 34 is removably coupled to the spark generator 50 such that an end portion 36 of the safety tab 34 is disposed between the spark generator 50 and the fuse 52. The combination of a spark generator 50 and fuse 52 can have the same or similar combustion attributes of previously-described igniter 14. Spark generator 50 can be a variety of mechanically-activated friction-type sparking devices such as, but not limited to, pull-type spark generators (also known as "poppers") and push-type spark generators used in known gas grills. Fuse 52 can be any known fuse or primer cord that combusts to define a short-term burn event (e.g., on the order of approximately 2-5 seconds) when exposed to a spark. Combustible material 54 has the same material and combustion attributes as previously-described combustion material 16.

The safety tab 34, when coupled to the spark generator 50, prevents combustion of the fuse 52 or primer cord. More specifically, the safety tab 34 prevents the fuse 52 from being exposed to the spark produced when the spark generator is activated, thereby preventing combustion of the fuse. As shown in FIG. 6, at least an end portion 36 of the safety tab 34 can be positioned within the casing 42 between the spark generator 50 and the fuse 52 and the combustible material 54, when the safety tab 34 is coupled thereto. An opposing end portion 38 of the safety tab 34 is disposed external to the casing 42, and an elongate portion of the safety tab 34 extends between the end portions 36, 38. The elongate portion can, for example, be substantially parallel to the fuse 52. In this manner, prior to use of the fire starter 40, a user can pull on the end portion 38 of the safety tab 34 external to the casing 42 to remove the safety tab 34 from the spark generator 50. The safety tab 34, when removed from the spark generator 50, allows (or otherwise discontinues preventing) combustion of the fuse 52.

Fire starter 40 also includes an actuator 56 coupled to spark generator 50. By way of an illustrative example, if spark generator 50 is a pull-type device, actuator 56 can be a line/string coupled to spark generator 50 and extended through casing 42 to be accessible on the outside of casing 42. An anchoring line 58 can be attached to spark generator 50 (or casing 42) and extended though casing 42 to be accessible as a loop on the outside of casing 42. Anchoring line 58 has the attributes and function of previously-described anchoring line 32. By attaching anchoring line 58 to spark generator 50, a pulling/activating force applied to actuator 56 does not get transferred to casing 42. By isolating casing 42 from the pulling/activating force, casing 42 is not subject to tensile stresses. Isolating casing 42 from tensile stresses is important when casing 42 is made from a mixture of paraffin wax and cellulose material, i.e., a material that does not possess high tensile strength.

Figure 7:
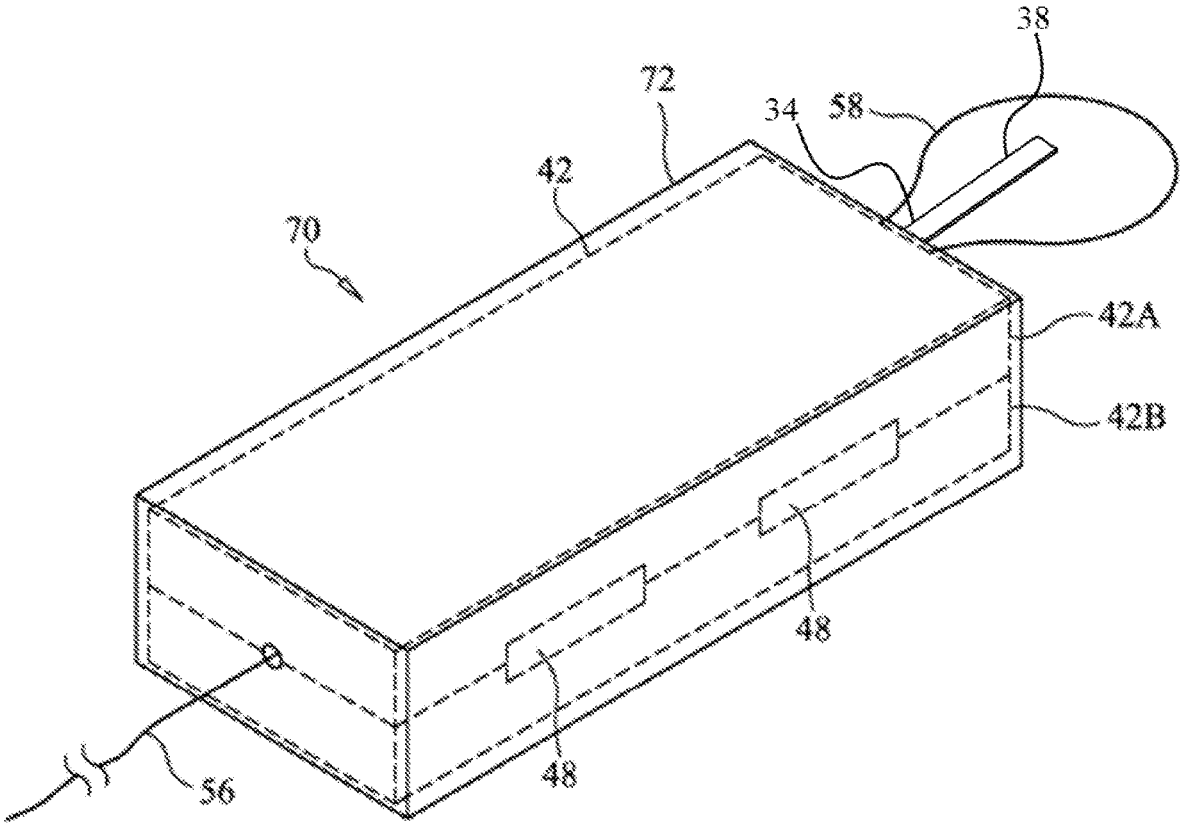
FIG. 7 is a perspective view of a fire starter with a paper overwrap in accordance with another embodiment.

FIG. 7 shows a fire starter 70, according to another embodiment. Fire starter 70 includes the components of fire starter 40, and further includes an overwrapping of paper 72 to provide the same benefits of previously-described paper overwrap 22.

An apparatus according to an embodiment is illustrated in FIGS. 8-12. The apparatus 100 can be a fire starter similar or identical in many respects to any fire starter described herein (e.g., fire starter 10, 20, 30, 40 and/or 70).

The apparatus 100 is self-contained in that no external source of thermal energy is required to initiate combustion. Rather, the apparatus 100 is activated by a simple and non-thermal manual activation to initiate combustion. The apparatus 100 includes a safety feature, and more specifically a safety tab as described in more detail herein, to prevent inadvertent combustion of burnable or combustible materials therein even in the event that the apparatus 100 is activated. The apparatus 100 is configured to, when activated and with the safety feature removed, produce a plurality of thermal events resulting in an enduring flame suitable for starting a fire for example in a stack of wood, charcoal, or other suitable fuel material. The apparatus 100 can be used in any suitable indoor or outdoor environment, and even in very windy, outdoor environments.

The apparatus 100 includes a casing 110, igniter 140 disposed in the casing 110, a safety tab 130 removably coupled to the igniter 140 and actuators 170, 170' coupled to the igniter 140. The apparatus 100 can generally be a hand-held structure, or otherwise have a size, shape and weight suitable for being portable by hand. For example, the apparatus 100 can have a width within the range of about 3 inches to about 8 inches (about 7.5 cm to 20 cm), or more particularly 5 inches (about 12.7 cm), a height within the range of about 0.5 inches to about 2 inches (about 1.25 cm about 5 cm), or more particularly about 1 inch (about 2.5 cm), and/or a depth within the range of about 1 inch to about 3 inches (about 2.5 cm to about 7.5 cm), or more particularly 2 inches (about 5 cm). In some implementations, the apparatus 100 can have dimensions like that of a fire log. As such, in some implementations, the apparatus 100 can have a width within the range of about 10 inches to about 24 inches (about 25 cm to about 60) cm), a height within the range of about 2 inches to about 8 inches (about 5 cm to about 20 cm) and/or a depth within the range of about 2 inches to about 8 inches (about 5 cm to about 20) cm). In another example, the apparatus 100 can be substantially sized and shaped to fit within a palm of a user's hand (e.g., like a pack of gum or box of matches). As such, in some implementations, the apparatus 100 can have a width within the range of about 1 inch to about 4 inches (about 2.5 cm to about 10 cm), a height within the range of about 0.25 inches to about 2 inches (about 0.6 cm to about 5 cm), and/or a depth within the range of about 0.5 inches to about 2 inches (about 1.25 cm to about 5 cm).

Figure 8:
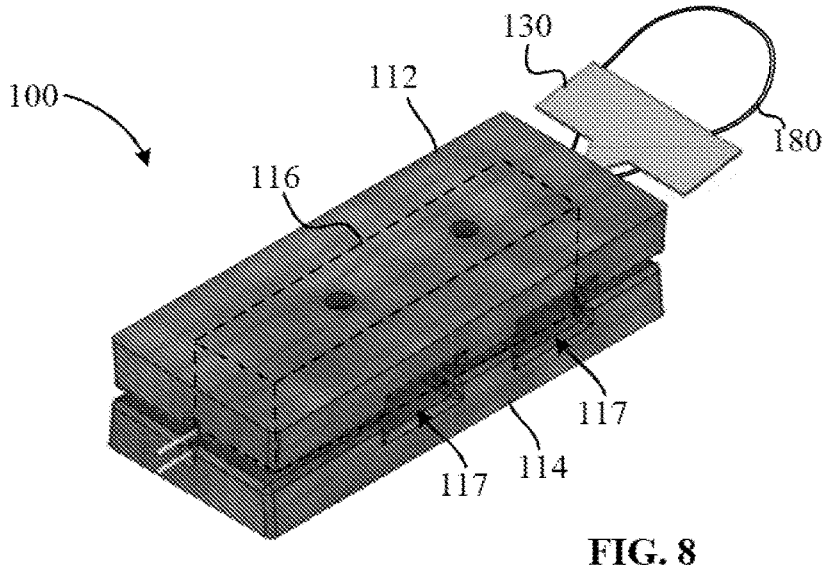
FIG. 8 is a perspective view of an apparatus according to an embodiment.
Figure 9:
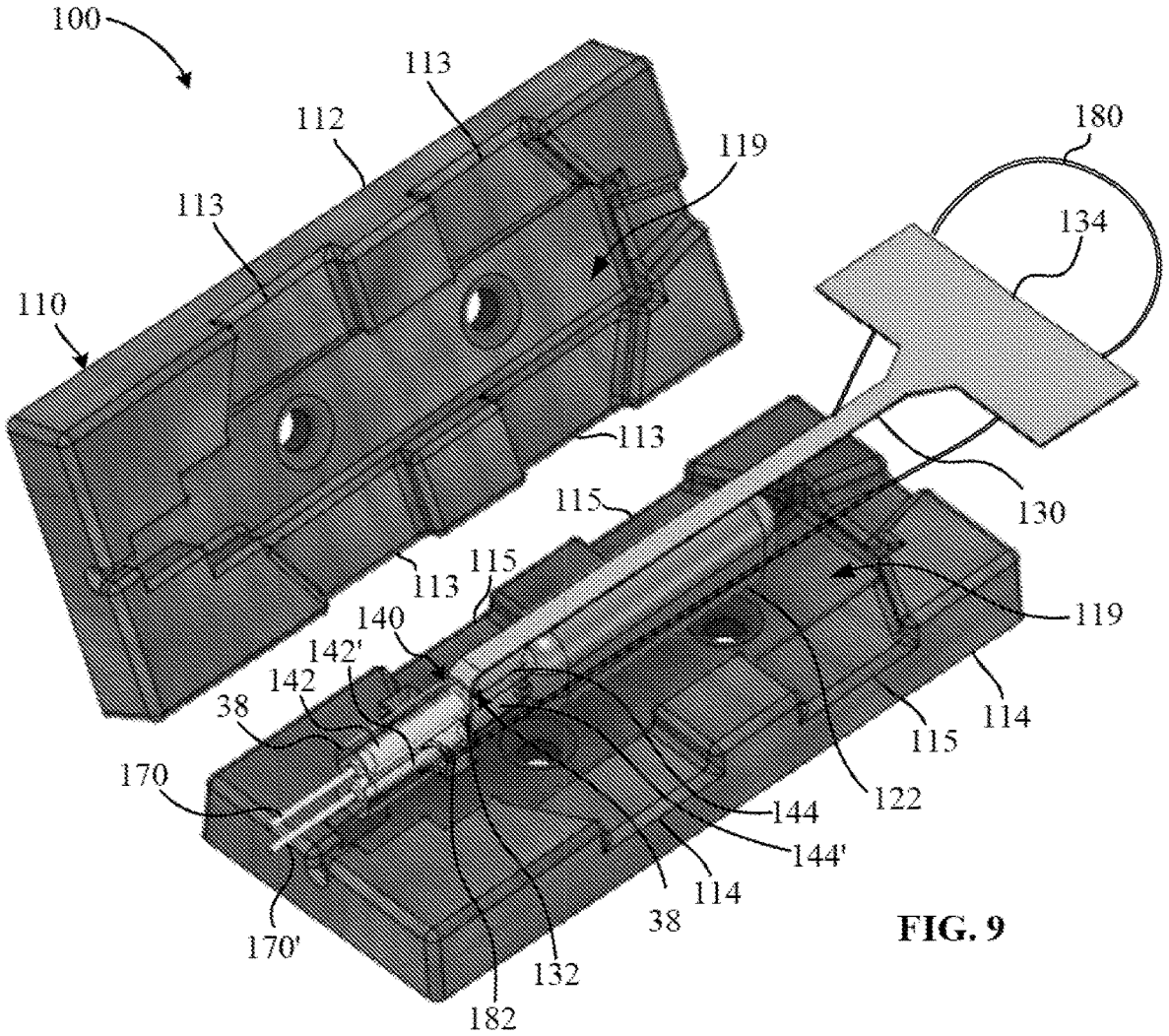
FIG. 9 is a perspective view of the apparatus of FIG. 8 with a portion of a casing thereof displaced.

As shown in FIGS. 8-9, the casing 110 has a first side portion 112 and a second side portion 114 opposite the first side portion 112 and defines an interior chamber 116 (schematically illustrated with broken lines in FIG. 8) between the first side portion 112 and the second side portion 114. In some implementations, the side portions 112, 114 of the casing 110 are identical top and bottom clam shell portions.

The casing 110 is made from a burnable material (also referred to herein as a first material or first burnable material) that combusts when exposed to a flame. The casing 110 can have for example the same or similar material and combustion attributes as any other casing described herein (e.g., casing 12, 22, 32, 42 and/or 72). Each side portion 112, 114 can include a well region 119 such that, when side portions 112, 114 are positioned against one another in a mirror-image fashion, the two well regions 119 collectively define the interior chamber 116 of the casing 110. Channels 113, 115 are defined in each of side portions 112, 114, respectively, such that a corresponding plurality of vent holes 117 (shown in FIG. 8) are defined in casing 110 when side portions 112, 114 are positioned against one another. Each vent hole 117 defines a fluid communication path between the outside of casing 110 and interior chamber 116.

The apparatus 100 also includes a burnable material 122 (also referred to herein as a second material or second burnable material) that is disposed in the interior chamber 116 of the casing 100. The second burnable (or combustible) material 122 can be disposed in the casing 110 adjacent to the igniter 140. The second burnable material 122 can have for example the same or similar material and/or combustion attributes as previously-described combustion material 16 or combustible material 54.

The igniter 140 is disposed in the interior chamber 116 of the casing 100. The igniter 140 is configured to generate a first thermal event, in response to actuation of the actuator 170 and/or the actuator 170' as described in more detail herein. The first thermal event ignites the second burnable material 122, which, during combustion, causes a second thermal event that ignites the first burnable material 120 of the casing 110.

The igniter 140 can include a first portion (e.g., a spark generator) 142 and a second portion (e.g., a fuse) 144 coupled to and extended from the first portion (e.g., the spark generator 50), each disposed within the interior chamber 116 of the casing 110. Similarly, igniter 140' can include a third portion (e.g., spark generator 142') and a fourth portion (e.g., fuse 144'). Spark generator 142' can be the same as or similar to spark generator 142 and fuse 144' can be the same as or similar to fuse 144, and so each is not separately described in detail herein.

As shown in FIG. 9, the second material 122 is in contact with each fuse 144, 144'. The combination of the spark generator 142 and fuse 144 (and/or spark generator 142' and fuse 144') can have the same or similar combustion attributes of any igniter previously-described herein (e.g., igniter 14, or spark generator 50 and fuse 52). The spark generator 142 can be a variety of mechanically-activated friction-type sparking devices such as, but not limited to, pull-type spark generators (also known as "poppers") and push-type spark generators used in conventional gas grills. The fuse 144 can be any known fuse or primer cord that combusts to define a short-term burn event (e.g., on the order of approximately 2-5 seconds) when exposed to a spark. In use, when the spark generator 142 is activated (e.g., by actuation of the actuator 170), the spark generator 142 generates a spark. The fuse 144, when exposed to the spark, combusts to define a burning fuse for a time. Combustion of the fuse 144 generates the first thermal event, such that the burning fuse ignites the second burnable material 122.

Figure 13:
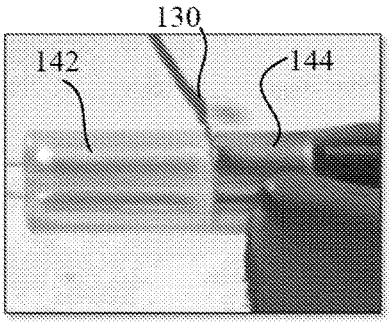
FIG. 13 is a side view of a portion of an apparatus according to an embodiment with a safety tab coupled to an igniter and prior to activation of the igniter.
Figure 14:
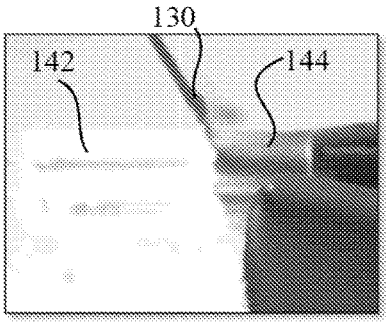
FIG. 14 is a side view of the portion of the apparatus of FIG. 13 with the safety tab coupled to the igniter during activation of the igniter in which a spark is produced.
Figure 15:
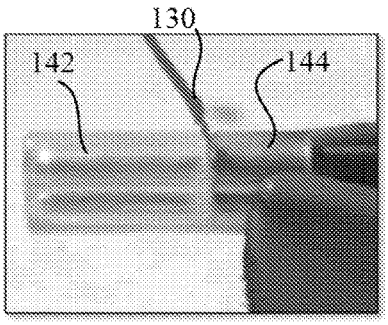
FIG. 15 is a side view of the portion of the apparatus of FIG. 13 with a safety tab coupled to an igniter after activation of the igniter.
Figure 16:
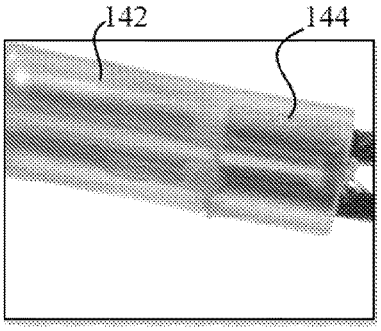
FIG. 16 is a side view of the portion of the apparatus of FIG. 13 with the safety tab removed and prior to activation of the igniter.
Figure 17:
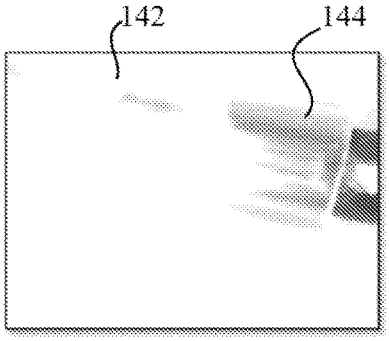
FIG. 17 is a side view of the portion of the apparatus of FIG. 13 with the safety tab removed during activation of the igniter in which a spark is produced.
Figure 18:
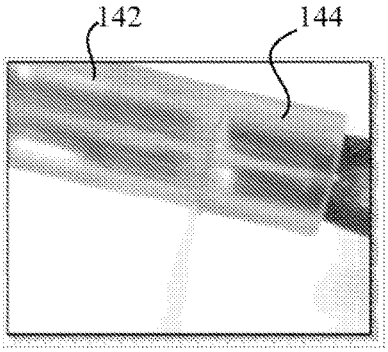
FIG. 18 is a side view of the portion of the apparatus of FIG. 13 with the safety tab removed after activation of the igniter showing combustion of a fuse of the igniter.

The safety tab 130 is removably coupled to the igniter 140. The safety tab 130 prevents generation of the first thermal event when the safety tab 130 is coupled to the igniter 140, or more specifically to the spark generator 142, 142'. The safety tab 130 can be at least partially disposed in the igniter 140 when the safety tab 130 is removably coupled to the igniter 140. For example, an end portion 132 of the safety tab 130 can be disposed between the spark generator 142 of the igniter 140 and the fuse 144 of the igniter 140 (and between spark generator 142' and fuse 144'), thereby providing a physical barrier that prevents a spark generated by the spark generator 142 from combusting the fuse 144. As such, if the apparatus 100 is inadvertently actuated when the safety tab 130 is in place (e.g., in a first position, see FIG. 13), the igniter 140 may be ignited, however the igniter is prevented from combusting the second burnable material 122 (see, e.g., FIG. 14 in which the spark generator 142 has produced a spark and FIG. 15 in which the spark has died out and the fuse 142 did not combust due to the presence of the safety tab 130). Even more specifically, even if the actuator 170 actuates either or both spark generators 142, 142' to produce a spark, the safety tab 130 when coupled to the igniter 140 (or spark generators 142, 142' specifically) prevents the spark from combusting either of the fuses 144, 144'. Because the fuses 144, 144' do not combust to generate a burning fuse, the burnable material 122 is not ignited. In this manner, the safety tab 130 provides a physical break in the chain of thermal events otherwise caused by actuation of the apparatus 100 in the absence of the safety tab (as shown in FIGS. 16-18). Thus, the safety tab 130 is configured to allow (or discontinue preventing) generation of the first thermal event when the safety tab 130 is removed from the igniter 140 (e.g., is moved to a second or removed position).

The safety tab 130 is removable, for example, by pulling the safety tab from the igniter 140 (and optionally the casing 110) or at least a sufficient distance to remove the safety tab from being disposed between portions of, or otherwise coupled to, the igniter 140. The safety tab 130 can include an opposing end portion 134 disposed external to the casing 110, which can be manually gripped by a user to pull to remove the safety tab 130 from the igniter 140. As shown in FIG. 9, the safety tab 130 can have a generally "T"-shaped configuration with the cross-portion of the "T" (e.g., end portion 134) disposed external to the casing 110 and the vertical bar portion of the "T" extended through the casing such that opposing end portion 132 thereof is inserted into and/or coupled to the igniter 140. The end portion 134 of the safety tab 130 external to the casing 110 can include instructions printed thereon, such as to remove the safety tab before use. The end portion 134 of the safety tab 130 can be sized and shaped to be positioned against an end of the casing 110 so that the end portion 134 covers a portion of an anchor line 180 disposed external to the casing 110 and/or contains the external portion of the anchor line 180 to the casing 110, before the safety tab is removed. The safety tab 130 can be constructed of any suitable flame fire-retardant material, such as a metal (e.g., aluminum, stainless steel, or copper) or a fire-retardant fabric or fiber.

Figure 10:
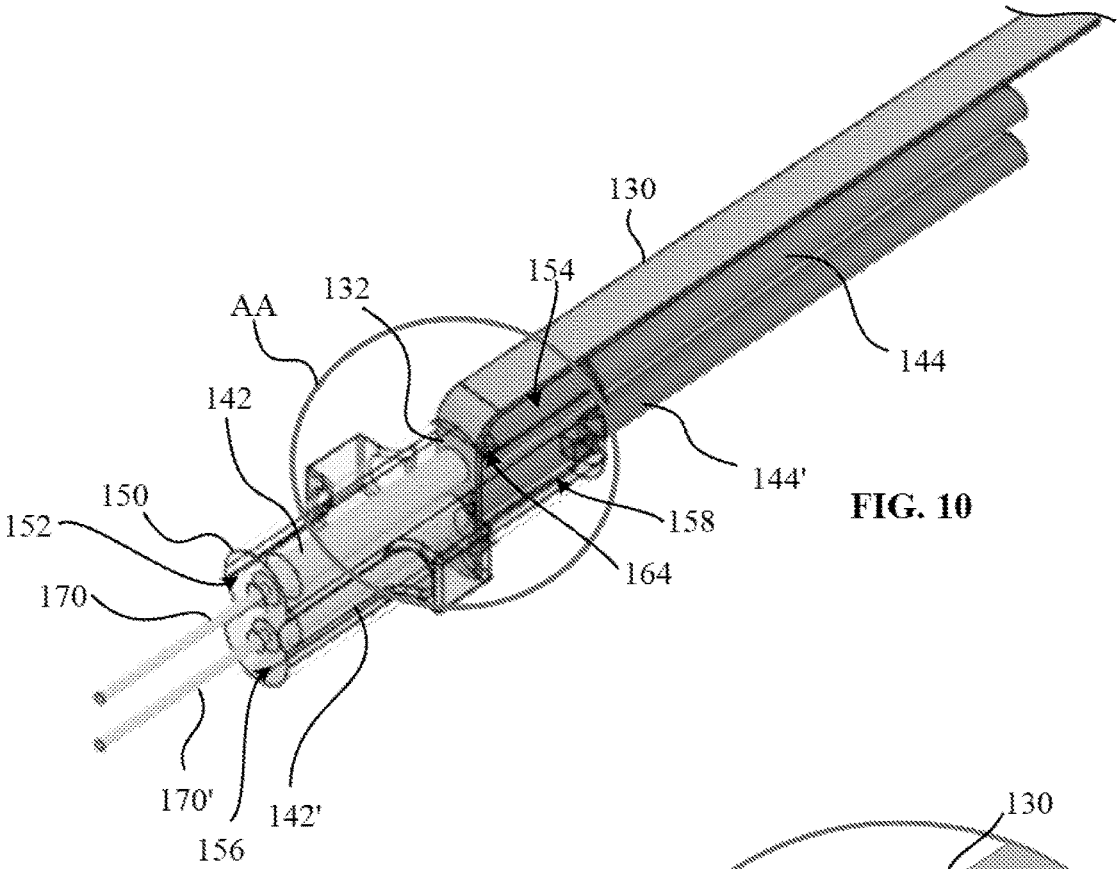
FIG. 10 is a perspective view of a portion of the apparatus of FIG. 8.

The apparatus 100 includes a housing 150 (shown in transparency in FIGS. 9-12 for ease of viewing other features) disposed in the interior chamber 116 of the casing 110. The housing 150 can couple portions of the igniter 140 together, as described in more detail herein. More specifically, as shown in FIG. 10, the housing 150 couples the spark generators 142, 142" to the fuses 144, 144'. The housing 150 can be constructed of any suitable material, such as a plastic, silicone, wood, bamboo, paper, or the like, though it is preferably constructed of a material that will substantially burn up during use of the apparatus 100.

The housing 150 can define a first chamber 152 within which the spark generator 142 (or at least a first portion of the igniter 140) is disposed and a second chamber 154 within which a portion of the fuse 144 (or at least a second portion of the igniter 140) is disposed. Each chamber 152, 154 can be an elongate cylinder or any other suitable shape. The first chamber 152 can have an elongate axis that is the same as or substantially parallel to an elongate axis of the second chamber 154.

The housing 150 can define a third chamber 156 within which the spark generator 142" (or at least the third portion of the igniter 140) is disposed and a fourth chamber 158 within which at least a portion of the fuse 144" (or at least the fourth portion of the igniter 140) is disposed. Each chamber 156, 158 can be an elongate cylinder or any other suitable shape. The third chamber 156 can have an elongate axis that is the same as or substantially parallel to an elongate axis of the fourth chamber 158. The spark generators 142, 142' and fuses 144, 144" can be coupled within the respective chamber 152, 154, 156, 158 by any suitable coupling method including an adhesive, a clamp, a resistance fit, or the like.

Figure 11:
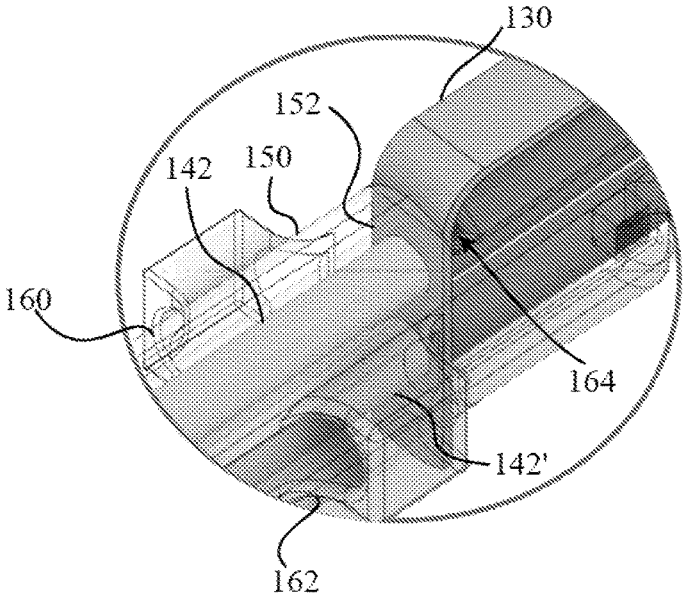
FIG. 11 is an enlarged view of the portion of FIG. 10 identified by circle AA.
Figure 12:
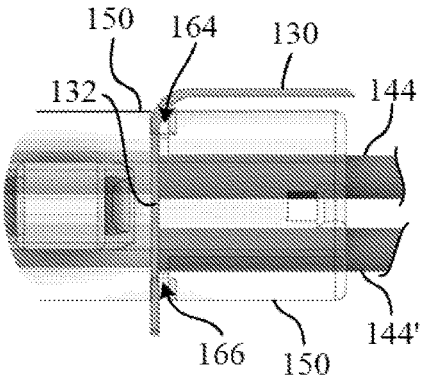
FIG. 12 is a side view of the portion of the apparatus of FIG. 11.

As shown in FIGS. 10-12, the first chamber 152 and third chamber 156 of the housing 150 can be in a substantially stacked configuration, and the second chamber 154 and the fourth chamber 158 can be in a substantially stacked configuration. As such, the first and third chambers 152, 156 (and similarly the spark generators 142, 142') are arranged substantially parallel within the housing 150 and therefore within the internal chamber 116 of the casing 110. Similarly, the second and fourth chambers 154, 158 (and similarly at least portions of fuses 144, 144') are positioned substantially parallel within the internal chamber 116 of the casing 110.

The housing 150 can define an elongate opening 164 in a sidewall or outer surface of the housing. Elongate opening 164 can be sized and shaped to receive at least a portion of the safety tab 130 (e.g., end portion 132) therethrough. The end portion 132 of the safety tab 130 is disposed through the elongate opening 164 when the safety tab is in a first (or coupled) position. The location of the elongate opening 164 allows the end portion 132 of the safety tab 130 to be positioned between the first chamber 152 of the housing 150 and the second chamber 154 of the housing, so that the end portion 132 of the safety tab 130 is positioned between the first portion of the igniter (or spark generator 142) and the second portion of the igniter (or fuse 144) (and optionally between the third portion of the igniter, or spark generator 142', and the fourth portion of the igniter, or fuse 144'), when the safety tab 130 is removably coupled to the igniter 140.

The housing 150 can define another elongate opening 166 in a different (e.g., opposing) sidewall or outer surface of the housing (e.g., opposite the sidewall or outer surface defining elongate opening 164) such that the end portion 132 of the safety tab 130 can be extended fully through the housing 150 to exit from an opposing side of the housing, as shown in FIG. 12.

As shown in FIG. 10, the apparatus 100 (e.g., a fire starter) also includes actuators 170, 170') coupled to the spark generators 140, 140', respectively. The actuator 170' is substantially the same as the actuator 170, as so is not separately described in detail herein. The actuator 170 is configured to activate the igniter 140 to generate the first thermal event. By way of example, if the spark generator 142 is a pull-type device as shown in FIG. 8, the actuator 170 can be a line/string coupled to the spark generator 142 and extended through casing 110 to be accessible external to the casing 110. The actuator 170 can be configured to be pulled in a first direction to activate the igniter. The safety tab 130 can be configured to be pulled in a second, different (e.g., opposite) direction to remove the safety tab 130 from the igniter 140 (or the spark generator 170, 170').

The actuator 170 can be configured to activate the igniter 140 to generate the first thermal event independently of whether the safety tab 130 is coupled to the igniter 140. More specifically, even when the safety tab 130 is coupled to the igniter, the actuator 170 can activate the first portion or spark generator 142 of the igniter 140, as described above. If the safety tab 130 is coupled to the igniter 140, however, the safety tab prevents the spark from the spark generator 142 from igniting the fuse 144, and thereby generation of the first thermal event is prevented.

The anchor line 180 (shown in FIGS. 8-9) can be attached to the igniter 140 or casing 110 and extended through the casing 110 to be accessible as a loop on the outside of casing 110. For example, end portion 184 of the anchor line 180 can be coupled to the attachment locations 162 of the housing 150 (and an opposing end portion, not shown, of the anchor line 180 can be coupled to the attachment location 160). The anchor line 180 can have the same or similar attributes and/or function of any anchor line described herein (e.g., anchoring line 32, anchoring line 58). By attaching anchor line 180 to the igniter 140 or to housing 160, a pulling/ activating force applied to actuator 170 does not get transferred to casing 110. By isolating the casing 110 from the pulling/activating force, the casing 110 is not subject to tensile stresses during actuation. Isolating casing 110 from tensile stresses is important when casing 110 is made from a mixture of paraffin wax and cellulose material, i.e., a material that does not possess high tensile strength.

The apparatus 100 can also include an overwrapping of paper (not shown in FIGS. 8-9) which can be the same or similar as, and which can provide the same or similar benefits as, previously-described paper overwrap 22 or 72.

Figure 19:
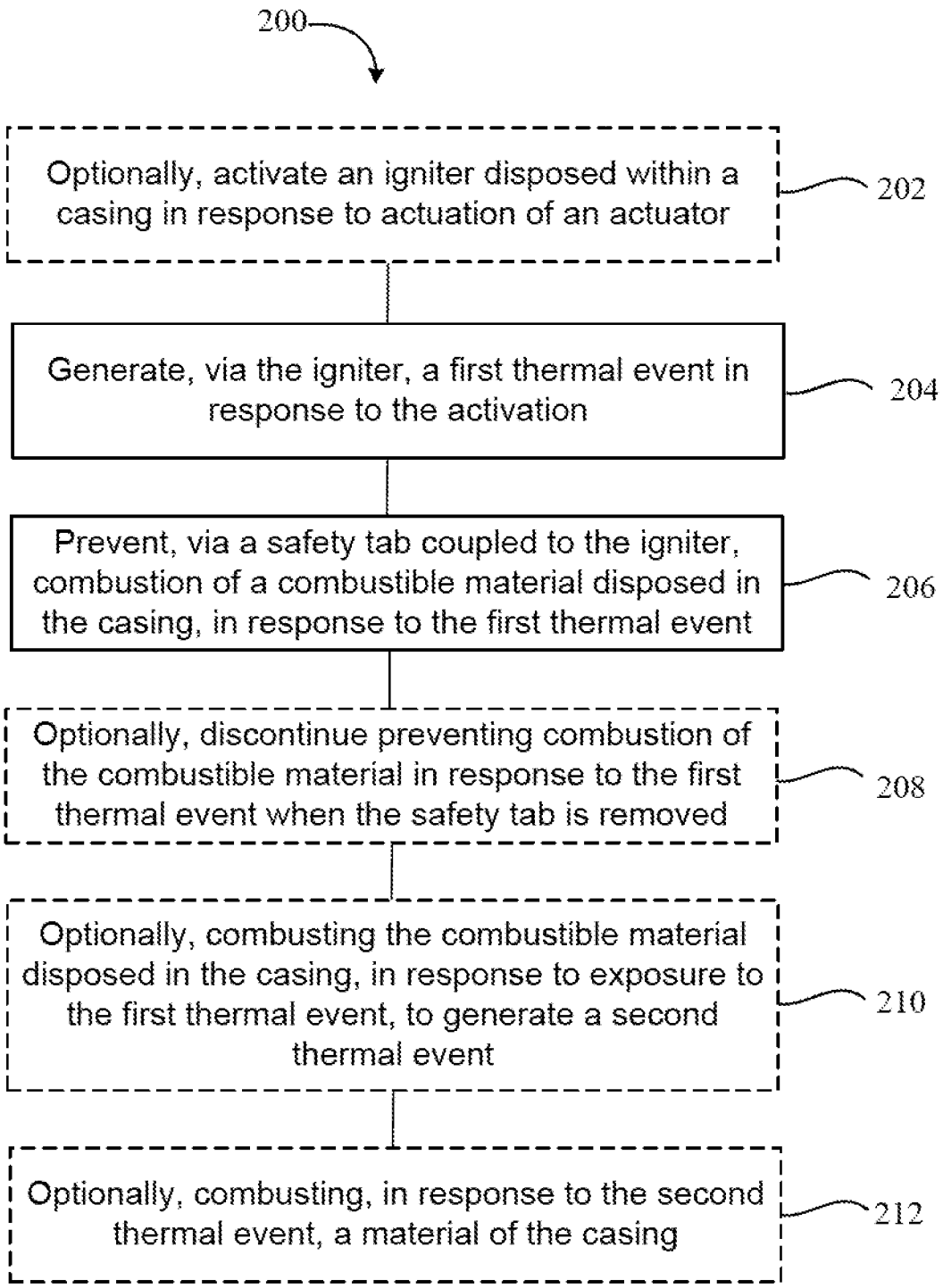
FIG. 19 is a flowchart of a method, according to an embodiment.

A method 200 according to an embodiment is illustrated in FIG. 19. The method can include actuating an actuator (not shown in FIG. 19). At 202, the method 200 can optionally include activating an igniter (e.g., igniter 140) disposed within a casing (e.g., casing 110) in response to actuation of an actuator. At 204, the method 200 can include generating, via the igniter, a first thermal event in response to the activation. For example, generating the first thermal event can include generating a spark via a spark generator of the igniter. At 206, the method 200 includes preventing, via a safety tab (e.g., safety tab 130) coupled to the igniter, combustion of a combustible material (e.g., second material 122) disposed in the casing in response to the first thermal event. At 208, the method 200 optionally includes discontinuing preventing combustion of the combustible material in response to the first thermal event (or spark) when the safety tab is removed. At 210, the method 200 optionally includes combusting the combustible material disposed in the casing, in response to exposure to the first thermal event (e.g., a burning fuse ignited by the spark) to generate a second thermal event (e.g., a flame). At 212, the method 200 optionally includes combusting a material of the casing, in response to the second thermal event.

The advantages of the fire starters described herein are numerous. The fire starter does not require any externally-supplied source of thermal energy so that matches, lighters, etc., are not needed for its use. The fire starter is completely self-contained with its igniting thermal event devices being protected from wind thereby assuring its effectiveness in hostile outdoor environments. The fire starter's chain of thermal events for starting a fire is triggered by a single and simple mechanical action. At the same time, because the mechanical activation of the fire starter involves a series of purposeful events, i.e., removal of the safety tab and actuation of the actuator, the chance of its inadvertent ignition is greatly reduced or minimized.

While various embodiments have been described above, it should be understood that they have been presented by way of example only, and not limitation. Where schematics and/or embodiments described above indicate certain components arranged in certain orientations or positions, the arrangement of components may be modified. While the embodiments have been particularly shown and described, it will be understood that various changes in form and details may be made. Although various embodiments have been described as having particular features and/or combinations of components, other embodiments are possible having any combination or sub-combination of any features and/or components from any of the embodiments described herein. Further, although methods have been described herein in reference to a specific embodiment, the methods can be executed using any suitable device embodiment described herein.

For example, although a safety tab is described as being pulled to be removed from the igniter or spark generator, in some implementations, a safety tab can be pushed or pressed to be uncoupled from the igniter such that the igniter can produce the thermal event (or such that a spark from the spark generator can cause combustion of a fuse).

In another example, any of the fire starters described herein can include a housing coupled to the igniter similar to the housing 150 illustrated and described herein with respect to apparatus 100.

In another example, although the housing 150 is illustrated and described herein as including four chambers, in some implementations, the housing 150 can include fewer chambers (e.g., one or two chambers, such that a single spark generator and a single fuse are coupled to the housing in a single chamber of in each of two chambers, respectively, or such that one or more spark generators are associated with one chamber and one or more fuses are associated with the other chamber) or more chambers.

In yet another example, an apparatus can include a housing configured to retain the igniter portions (e.g., the spark generator and fuse) thereto but be differently configured so as to not include the chambers described herein. For example, such a housing can include open channels, clips, or the like.

Although the safety tab 130 is shown and described herein as defining a bend (e.g., a 90 degree bend) such that the safety tab is extended from the casing 110 opposite a side from which the actuators 170, 170' are extended, in other embodiments, the safety tab can extend from a different portion of the casing 110. For example, the safety tab can be substantially linear along its length, and the safety tab can extend from a side portion of the casing 110 (e.g., orthogonal to the direction in which the actuator 170, 170' is actuated).

Although the safety tab 130 is shown and described herein as being a pull-type safety tab, in other embodiments, an apparatus according to an embodiment can include a safety tab or safety lock that is differently configured. For example, in some embodiments, an apparatus can include a safety tab or safety lock that is configured to be rotated from a first position in which the safety tab prevents a thermal event of the igniter to combust the second material to a second position in which the safety tab discontinues preventing the thermal event of the igniter to combust the second material. In such embodiments, for example, the housing could include a pivot about which the safety tab is configured to rotate from its first position to its second position.

Although apparatus 100 is shown and described herein as including two actuators 170, 170', in some embodiments, the apparatus 100 can include a single actuator operable to activate both of spark generators 142, 142'. In another example, in some embodiments, each of actuators 170, 170' can be actuated together in a single actuation action (e.g., push or pull, or the like, of actuators 170, 170'). For example, actuators 170, 170' can be constructed of a cord or string or the like that is braided, glued, wound, or otherwise coupled together at least at an end portion external to the casing 110.

In some implementations, an apparatus includes a casing that has a first side portion and a second side portion opposite the first side portion and that defines an interior chamber between the first side portion and the second side portion. The casing is made from a first burnable material. The apparatus also includes a second burnable material disposed in the interior chamber of the casing, an igniter a safety tab and an actuator. The igniter is disposed in the interior chamber of the casing and is configured to generate a first thermal event to ignite the second burnable material that, during combustion, causes a second thermal event that ignites the first burnable material. The safety tab is removably coupled to the igniter and is configured to prevent generation of the first thermal event when the safety tab is coupled to the igniter. The safety tab is configured to allow generation of the first thermal event when the safety tab is removed from the igniter. The actuator is coupled to the igniter and is configured to activate the igniter to generate the first thermal event.

In some implementations, the actuator can be configured to activate the igniter to generate the first thermal event independently of whether the safety tab is coupled to the igniter.

In some implementations, the safety tab can be at least partially disposed in the igniter when the safety tab is removably coupled to the igniter.

In some implementations, the apparatus can include a housing disposed in the interior chamber of the casing. The housing can define a first chamber and a second chamber. At least a first portion of the igniter can be disposed in the first chamber of the housing, and at least a second portion of the igniter can be disposed in the second chamber of the housing. An end portion of the safety tab can be positioned between the first chamber of the housing and the second chamber of the housing, so that the end portion of the safety tab can be positioned between the first portion of the igniter and the second portion of the igniter, when the safety tab is removably coupled to the igniter.

In some implementations, the apparatus includes a housing disposed in the interior chamber of the casing. The housing defines a first chamber and a second chamber. At least a first portion of the igniter can be disposed in the first chamber of the housing, and at least a second portion of the igniter can be disposed in the second chamber of the housing. A sidewall of the housing defines an elongate opening. The safety tab can be disposed through the elongate opening such that an end portion of the safety tab can be positioned between the first chamber of the housing and the second chamber of the housing when the safety tab is removably coupled to the igniter.

In some implementations, the apparatus also includes a housing disposed in the interior chamber of the casing. The igniter can be at least partially disposed in the housing. The housing can define an elongate opening through which a first end portion of the safety tab is disposed when the safety tab is removably coupled to the igniter. A second end portion of the safety tab can be disposed external to the casing when the safety tab is removably coupled to the igniter.

In some implementations, the igniter can include a spark generator and a fuse. The spark generator can be disposed in the interior chamber of the casing to generate a spark when the spark generator is activated. The fuse is disposed in the interior chamber of the casing and can also be coupled to the spark generator and extended therefrom. The fuse combusts to define a burning fuse for a time when exposed to the spark. The safety tab is removably coupled to the spark generator and is configured to prevent combustion of the fuse when the spark generator generates the spark when the safety tab is coupled to the spark generator.

In some implementations, the igniter is a first igniter, and the apparatus also includes a second igniter disposed in the interior chamber of the casing and configured to generate a third thermal event to ignite the second burnable material that, during combustion, causes the second thermal event that ignites the first burnable material. The safety tab can be removably coupled to the first igniter and the second igniter. The safety tab can be configured to prevent generation of the third thermal event when the safety tab is coupled to the second igniter and configured to discontinue prevention of the first thermal event when the safety tab is removed from the second igniter. The actuator can be coupled to the second igniter and configured to activate the second igniter to generate the third thermal event.

In some implementations, the actuator can be configured to be pulled in a first direction to activate the igniter and the safety tab can be configured to be pulled in a second direction different from the first direction to remove the safety tab from the igniter.

In some implementations, an apparatus includes a casing defining an interior chamber and made from a first burnable material. The apparatus also includes a second burnable material disposed in the interior chamber of the casing, an igniter, a safety tab and an actuator. The igniter is disposed in the interior chamber of the casing and includes a first portion and a second portion. The second portion of the igniter is configured to combust in response to activation of the first portion of the igniter to generate a first thermal event to ignite the second burnable material that, during combustion, causes the second thermal event that ignites the first burnable material. The safety tab is removably coupled to the igniter between the first portion of the igniter and the second portion of the igniter when the safety tab is in a first position. The safety tab has a second position in which the safety tab is removed from being between the first portion of the igniter and the second portion of the igniter. The safety tab is configured to prevent combustion of the second portion of the igniter in response to activation of the first portion of the igniter when the safety tab is in the first position. The actuator is coupled to the igniter and is configured to activate the first portion of the igniter.

In some implementations, the first portion of the igniter is configured to generate a spark when the igniter is activated and the second portion of the igniter is configured to combust to define a burning fuse when exposed to the spark.

In some implementations, a first end portion of the safety tab is disposed between the first portion of the igniter and the second portion of the igniter when the safety tab is in the first position, and a second end portion of the safety tab is disposed external to the casing when the safety tab is in the first position.

In some implementations, the apparatus also can include a housing disposed in the interior chamber of the casing. The igniter can be at least partially disposed in the housing. The housing can define an elongate opening through which an end portion of the safety tab is disposed when the safety tab is in the first position.

In some implementations, the actuator can be configured to be pulled in a first direction to activate the igniter, and the safety tab can be configured to be pulled in a second direction different from the first direction to move the safety tab from the first position to the second position.

In some implementations, an apparatus includes a casing defining an interior chamber and being made from a first material that combusts when exposed to a flame. The apparatus also includes a spark generator disposed in the interior chamber of the casing to generate a spark when the spark generator is activated and a fuse disposed in the interior chamber of the casing. The fuse is coupled to the spark generator and extends therefrom. The fuse combusts to define a burning fuse when exposed to the spark. The apparatus also includes a safety tab removably coupled to the spark generator, a second material disposed in the interior chamber of the casing and adjacent the fuse and which combusts, when the second material is exposed to the burning fuse, to define the flame, and an actuator coupled to the spark generator and having at least a portion that is positioned outside of the casing and that is configured to be pulled in a direction to activate the spark generator. The safety tab configured to prevent combustion of the fuse when the safety tab is coupled to the spark generator.

In some implementations, the apparatus can also include a housing disposed in the interior chamber of the casing and that defines a first chamber and a second chamber. At least a portion of the spark generator can be disposed in the first chamber of the housing, and at least a portion of the fuse can be disposed in the second chamber of the housing. An end portion of the safety tab can be positioned between the first chamber of the housing and the second chamber of the housing when the safety tab is removably coupled to the spark generator.

In some implementations, the apparatus also includes a housing disposed in the interior chamber of the casing. The housing defines a first chamber having a first elongate axis and a second chamber having a second elongate axis, where the first elongate axis can be the substantially the same as or parallel to the second elongate axis. At least a portion of the spark generator can be disposed in the first chamber of the housing, and at least a portion of the fuse can be disposed in the second chamber of the housing. A sidewall of the housing can define an elongate opening. The safety tab can be disposed through the elongate opening such that an end portion of the safety tab is positioned between the first chamber of the housing and the second chamber of the housing when the safety tab is removably coupled between the spark generator and the fuse.

In some implementations, the safety tab can include a first end portion that can be disposed between the spark generator and the fuse when the safety tab is removably coupled to the spark generator, and a second end portion that can be disposed outside of the casing when the safety tab is removably coupled to the spark generator.

In some implementations, the spark generator can be a first spark generator, the fuse can be a first fuse, the burning fuse can be a first burning fuse, and the spark can be a first spark, and the apparatus can also include a second spark generator disposed in the interior chamber of the casing to generate a second spark when the second spark generator is activated, and a second fuse disposed in the interior chamber of the casing. The second fuse can be coupled to the second spark generator and extended therefrom. The second fuse can combust to define a second burning fuse for a time when exposed to at least one of the first spark or the second spark. The safety tab can be removably coupled to the second spark generator and can be configured to prevent combustion of the second fuse when the safety tab is coupled to the second spark generator.

In some implementations, the spark generator is a first spark generator, the fuse is a first fuse, the burning fuse is a first burning fuse, and the spark is a first spark, and the apparatus can also include a second spark generator disposed in the interior chamber of the casing to generate a second spark when the second spark generator is activated. The second spark generator can be configured to be activated in response to the portion of the actuator being pulled in the first direction. The apparatus can also include a second fuse disposed in the interior chamber of the casing. The second fuse can be coupled to the second spark generator and extended therefrom. The second fuse can combust to define a second burning fuse for a time when exposed to at least one of the first spark or the second spark. The safety tab can be removably coupled to the second spark generator and can be configured to prevent combustion of the second fuse when the safety tab is coupled to the second spark generator.

As used in this specification and the appended claims, the singular forms "a," "an" and "the" include plural referents unless the context clearly dictates otherwise. Thus, for example, the term "a member" is intended to mean a single member or a combination of members, "a material" is intended to mean one or more materials, or a combination thereof.

As used herein, the terms "about" and/or "approximately" when used in conjunction with numerical values and/or ranges generally refer to those numerical values and/or ranges near to a recited numerical value and/or range. For example, in some instances, "about 40 [units]" can mean within ±25% of 40 (e.g., from 30 to 50). In some instances, the terms "about" and "approximately" can mean within ±10% of the recited value. In other instances, the terms "about" and "approximately" can mean within ±9%, ±8%, ±7%, ±6%, ±5%, ±4%, ±3%, ±2%, ±1%, less than ±1%, or any other value or range of values therein or therebelow. The terms "about" and "approximately" may be used interchangeably. Furthermore, although a numerical value modified by the term "about" or "approximately" can allow for and/or otherwise encompass a tolerance of the stated numerical value, it is not intended to exclude the exact numerical value stated.

In a similar manner, term "substantially" when used in connection with, for example, a geometric relationship, a numerical value, and/or a range is intended to convey that the geometric relationship (or the structures described thereby), the number, and/or the range so defined is nominally the recited geometric relationship, number, and/or range. For example, two structures described herein as being "substantially non-parallel" is intended to convey that, although a non-parallel geometric relationship is desirable, some parallelism can occur in a "substantially non-parallel" arrangement. Such tolerances can result from manufacturing tolerances, measurement tolerances, and/or other practical considerations (such as, for example, minute imperfections, age of a structure so defined, a pressure or a force exerted within a system, and/or the like). As described above, a suitable tolerance can be, for example, of ±1%, ±2%, ±3%, ±4%, ±5%, ±6%, ±7%, ±8%, ±9%, ±10%, or more of the stated geometric construction, numerical value, and/or range. Furthermore, although a numerical value modified by the term "substantially" can allow for and/or otherwise encompass a tolerance of the stated numerical value, it is not intended to exclude the exact numerical value stated.

The specific configurations of the various components described herein can also be varied. For example, the size and specific shape of the various components can be different from the embodiments shown, while still providing the functions as described herein. Additionally, the relative size of various components of the devices shown and described herein with respect to the size of other components of the devices are not necessarily to scale.

Similarly, where methods and/or events described above indicate certain events and/or procedures occurring in certain order, the ordering of certain events and/or procedures may be modified. While the embodiments have been particularly shown and described, it will be understood that various changes in form and details may be made.

What is claimed is:

1. An apparatus, comprising:

a casing having a first side portion and a second side portion opposite the first side portion and defining an interior chamber between the first side portion and the second side portion, the casing being made from a first burnable material;

a second burnable material disposed in the interior chamber of the casing;

a first igniter disposed in the interior chamber of the casing and configured to generate a first thermal event to ignite the second burnable material that, during combustion, causes a second thermal event that ignites the first burnable material;

a second igniter disposed in the interior chamber of the casing and configured to generate a third thermal event to ignite the second burnable material that, during combustion, causes the second thermal event that ignites the first burnable material;

a safety tab removably coupled to the first igniter and the second igniter, the safety tab configured to prevent generation of the first thermal event when the safety tab is coupled to the first igniter and to prevent generation of the third thermal event when the safety tab is coupled to the second igniter, the safety tab configured to allow generation of the first thermal event when the safety tab is removed from the first igniter, the safety tab configured to allow generation of the third thermal event when the safety tab is removed from the second igniter; and an actuator coupled to the first igniter and to the second igniter, the actuator configured to activate the first igniter to generate the first thermal event, the actuator configured to activate the second igniter to generate the third thermal event.

2. The apparatus of claim 1, wherein the actuator is configured to activate at least one of the first igniter or the second igniter independently of whether the safety tab is coupled to the first igniter or the second igniter, respectively.

3. The apparatus of claim 1, wherein the safety tab is at least partially disposed in at least one of the first igniter or the second igniter when the safety tab is removably coupled to the one of the first igniter or the second igniter.

4. The apparatus of claim 1, further comprising:

a housing disposed in the interior chamber of the casing, the housing defining a first chamber and a second chamber, at least a first portion of the first igniter disposed in the first chamber of the housing, at least a second portion of the first igniter disposed in the second chamber of the housing, an end portion of the safety tab being positioned between the first chamber of the housing and the second chamber of the housing, so that the end portion of the safety tab is positioned between the first portion of the first igniter and the second portion of the first igniter, when the safety tab is removably coupled to the first igniter.

5. The apparatus of claim 1, further comprising:

a housing disposed in the interior chamber of the casing, the housing defining a first chamber and a second chamber, at least a first portion of the first igniter disposed in the first chamber of the housing, at least a second portion of the first igniter disposed in the second chamber of the housing, a sidewall of the housing defining an elongate opening, the safety tab being disposed through the elongate opening such that an end portion of the safety tab is positioned between the first chamber of the housing and the second chamber of the housing when the safety tab is removably coupled to the first igniter.

6. The apparatus of claim 1, further comprising:

a housing disposed in the interior chamber of the casing, at least one of the first igniter or the second igniter being at least partially disposed in the housing, the housing defining an elongate opening through which a first end portion of the safety tab is disposed when the safety tab is removably coupled to the at least one of the first igniter or the second igniter, a second end portion of the safety tab being disposed external to the casing when the safety tab is removably coupled to the at least one of the first igniter or the second igniter.

7. The apparatus of claim 1, wherein:

at least one of the first igniter or the second igniter includes a spark generator and a fuse, the spark generator is disposed in the interior chamber of the casing to generate a spark when the spark generator is activated, the fuse is disposed in the interior chamber of the casing, the fuse coupled to the spark generator and extending therefrom, the fuse combusts to define a burning fuse for a time when exposed to the spark, and the safety tab is removably coupled to the spark generator, the safety tab is configured to prevent combustion of the fuse when the spark generator generates the spark when the safety tab is coupled to the spark generator.

8. The apparatus of claim 1, wherein the actuator is configured to be pulled in a first direction to activate the first igniter, the safety tab is configured to be pulled in a second direction different from the first direction to remove the safety tab from the first igniter.

9. An apparatus, comprising:

a casing defining an interior chamber, the casing being made from a first burnable material;

a second burnable material disposed in the interior chamber of the casing;

a first igniter disposed in the interior chamber of the casing, the first igniter including a first portion and a second portion, the second portion of the first igniter configured to combust in response to activation of the first portion of the first igniter to generate a first thermal event to ignite the second burnable material that, during combustion, causes the second thermal event that ignites the first burnable material;

a second igniter disposed in the interior of the casing, the second igniter including a first portion and a second portion, the second portion of the second igniter configured to combust in response to activation of the first portion of the second igniter to generate a third thermal event to ignite the second burnable material;

a safety tab removably coupled to the first igniter and the second igniter between the first portion of the first igniter and the second portion of the first igniter and between the first portion of the second igniter and the second portion of the second igniter when the safety tab is in a first position, the safety tab having a second position in which the safety tab is removed from being between at least one of the first portion of the first igniter and the second portion of the first igniter or the first portion of the second igniter and the second portion of the second igniter, the safety tab configured to prevent combustion of the second portion of the first igniter in response to activation of the first portion of the first igniter and to prevent combustion of the second portion of the second igniter in response to activation of the first portion of the second igniter when the safety tab is in the first position; and an actuator coupled to the first igniter and the second igniter, the actuator configured to activate the first portion of the first igniter and the first portion of the second igniter.

10. The apparatus of claim 9, wherein the first portion of the first igniter is configured to generate a spark when the first igniter is activated, the second portion of the first igniter is configured to combust to define a burning fuse when exposed to the spark.

11. The apparatus of claim 9, wherein a first end portion of the safety tab is disposed between the first portion of the first igniter and the second portion of the first igniter and between the first portion of the second igniter and the second portion of the second igniter when the safety tab is in the first position, a second end portion of the safety tab is disposed external to the casing when the safety tab is in the first position.

12. The apparatus of claim 9, further comprising:

a housing disposed in the interior chamber of the casing, at least one of the first igniter or the second igniter being at least partially disposed in the housing, the housing defining an elongate opening through which an end portion of the safety tab is disposed when the safety tab is in the first position.

13. The apparatus of claim 9, wherein the actuator is configured to be pulled in a first direction to activate at least one of the first igniter or the second igniter, the safety tab is configured to be pulled in a second direction different from the first direction to move the safety tab from the first position to the second position.

14. An apparatus, comprising:

a casing defining an interior chamber and being made from a first material that combusts when exposed to a flame;

a first spark generator disposed in the interior chamber of the casing to generate a first spark when the first spark generator is activated;

a second spark generator disposed in the interior chamber of the casing to generate a second spark when the second spark generator is activated;

a first fuse disposed in the interior chamber of the casing, the first fuse coupled to the first spark generator and extending therefrom, the first fuse combusting to define a first burning fuse when exposed to at least one of the first spark or the second spark;

a second fuse disposed in the interior chamber of the casing, the second fuse coupled to the second spark generator and extending therefrom, the second fuse combusting to define a second burning fuse for a time when exposed to at least one of the first spark or the second spark;

a safety tab removably coupled to the first spark generator and the second spark generator, the safety tab configured to prevent combustion of the first fuse and the second fuse when the safety tab is coupled to the first spark generator and the second spark generator;

a second material disposed in the interior chamber of the casing and adjacent the first fuse and the second fuse, the second material combusting, when the second material is exposed to at least one of the first burning fuse or the second burning fuse, to define the flame; and an actuator coupled to the first spark generator and the second spark generator, the actuator having at least a portion that is positioned outside of the casing and that is configured to be pulled in a direction to activate the first spark generator.

15. The apparatus of 14, further comprising:

a housing disposed in the interior chamber of the casing, the housing defining a first chamber and a second chamber, at least a portion of at least one of the first spark generator or the second spark generator disposed in the first chamber of the housing, at least a portion of at least one of the first fuse or the second fuse disposed in the second chamber of the housing, an end portion of the safety tab being positioned between the first chamber of the housing and the second chamber of the housing when the safety tab is removably coupled to the first spark generator and the second spark generator.

16. The apparatus of 14, further comprising:

a housing disposed in the interior chamber of the casing, the housing defining a first chamber having a first elongate axis and a second chamber having a second elongate axis, the first elongate axis being the substantially the same as or parallel to the second elongate axis, at least a portion of the first spark generator being disposed in the first chamber of the housing, at least a portion of the first fuse being disposed in the second chamber of the housing, a sidewall of the housing defining an elongate opening, the safety tab being disposed through the elongate opening such that an end portion of the safety tab is positioned between the first chamber of the housing and the second chamber of the housing when the safety tab is removably coupled between the first spark generator and the first fuse.

17. The apparatus of 14, wherein the safety tab includes a first end portion that is disposed between the first spark generator and the first fuse when the safety tab is removably coupled to the first spark generator, and a second end portion that is disposed outside of the casing when the safety tab is removably coupled to the first spark generator.

18. The apparatus of 14, wherein the second spark generator is configured to be activated in response to the portion of the actuator being pulled in the direction.

* * * * *